US007540289B2

(12) United States Patent
Habibi

(10) Patent No.: US 7,540,289 B2
(45) **Date of Patent: *Jun. 2, 2009**

(54) HAIR STYLING DEVICE AND METHOD OF OPERATION

(76) Inventor: Masood Habibi, 5521 Schaefer Ave., Chino, CA (US) 91710

( * ) Notice: Subject to any disclaimer, the term of this patent is extended or adjusted under 35 U.S.C. 154(b) by 0 days.

This patent is subject to a terminal disclaimer.

(21) Appl. No.: 11/526,207

(22) Filed: Sep. 22, 2006

(65) Prior Publication Data

US 2008/0072921 A1 Mar. 27, 2008

(51) Int. Cl.
*A45D 2/40* (2006.01)
*A45D 1/04* (2006.01)

(52) U.S. Cl. ..... 132/224; 132/229; 219/225

(58) Field of Classification Search ..... 132/224–226, 132/229; 219/225
See application file for complete search history.

(56) References Cited

U.S. PATENT DOCUMENTS

| | | | | |
|---|---|---|---|---|
| 190,960 | A | 5/1877 | Davis | |
| 1,465,838 | A | 8/1923 | Caneavri | |
| 1,588,241 | A | 6/1926 | Leland | |
| 1,731,522 | A | 10/1929 | Carlson | |
| 1,852,269 | A | 4/1932 | Siers | |
| 1,858,851 | A | 5/1932 | Buchanan | |
| 1,892,107 | A | 12/1932 | Jancke et al. | |
| 1,894,431 | A | 1/1933 | Vaghelatos | |
| 1,926,987 | A | 9/1933 | Durham et al. | |
| 1,957,049 | A | 5/1934 | Lakenbach | |
| 2,244,068 | A | 6/1941 | Kay | |
| 2,720,207 | A | 10/1955 | Burtnett | |
| 2,818,869 | A | 1/1958 | Rose | |
| 4,623,779 | A | 11/1986 | Raab | 219/365 |
| 4,739,151 | A | 4/1988 | Smal | 219/225 |
| 4,917,078 | A | 4/1990 | Zaborowski | 126/408 |
| 5,212,366 | A | 5/1993 | McDougall | 219/222 |
| 5,232,137 | A | 8/1993 | Devine | 224/252 |
| 5,263,501 | A | 11/1993 | Maznik | 132/228 |
| 5,294,777 | A | 3/1994 | Denhup | 219/225 |
| 5,400,809 | A | 3/1995 | Adams | 132/118 |
| 5,799,671 | A | 9/1998 | Takimae | 132/225 |
| 5,868,146 | A | 2/1999 | Henninger et al. | 132/227 |

(Continued)

FOREIGN PATENT DOCUMENTS

| | | |
|---|---|---|
| JP | 58092311 | 6/1983 |

(Continued)

OTHER PUBLICATIONS

International Search Report and Written Opinion for International Application No. PCT/US2007/020306, date of mailing Feb. 27, 2008.

*Primary Examiner*—Robyn Doan
(74) *Attorney, Agent, or Firm*—Nixon Peabody LLP; David B. Ritchie

(57) ABSTRACT

In one embodiment a hair styling device includes a first plate having a plurality of pins, a second plate having a plurality of pin-receiving apertures, each of the pin-receiving apertures configured to receive at least one respective pin from the first plate, a hinged frame holding the first plate and the second plate and hinged to permit a user to bring the first plate and the second plate into proximity with one another, and a vibrator coupled to vibrate the device.

4 Claims, 16 Drawing Sheets

U.S. PATENT DOCUMENTS

| | | | | |
|---|---|---|---|---|
| D411,333 | S | 6/1999 | Smal | D28/35 |
| 5,934,293 | A | 8/1999 | Kaizuka | 132/225 |
| 6,029,677 | A | 2/2000 | Nanba et al. | 132/225 |
| 6,070,596 | A | 6/2000 | Altamore | 132/225 |
| 6,119,702 | A * | 9/2000 | Habibi | 132/224 |
| 6,191,387 | B1 | 2/2001 | Smal | 219/225 |
| D440,710 | S | 4/2001 | Kaizuka | D28/35 |
| 6,223,753 | B1 | 5/2001 | Lo | 132/224 |
| 6,477,732 | B1 | 11/2002 | Cline et al. | 15/185 |
| D479,626 | S | 9/2003 | Colombo | D28/35 |
| D482,491 | S | 11/2003 | Maesawa et al. | D28/35 |
| D489,482 | S | 5/2004 | Cho | D28/35 |
| 7,341,064 | B2 * | 3/2008 | Habibi | 132/224 |
| 2002/0026206 | A1 | 2/2002 | Takehana | |
| 2006/0272669 | A1 * | 12/2006 | Imai et al. | 132/245 |

FOREIGN PATENT DOCUMENTS

| | | | |
|---|---|---|---|
| JP | 09191920 | | 7/1997 |
| JP | 2001037526 | * | 2/2001 |
| WO | 03/077702 | | 9/2003 |
| WO | 2007/060872 | | 5/2007 |

* cited by examiner

HAIR STYLING DEVICE AND METHOD OF OPERATION

BACKGROUND OF THE INVENTION

1. Technical Field

The present invention relates generally to the field of hair care and styling.

2. Background

Many devices have been devised over the ages to aid in styling hair. Hair curlers, for example, are used to impart curls into hair. They may be used on dry hair or wet hair. Steam may be applied to assist in setting the hair to the curl of the curlers. Curling irons typically incorporate an electrical heating element to heat one or both sides of a smooth but curved pair of mating surfaces between which hair is placed to be curled. The hair may be pulled through the interface of the mating surfaces of the curling iron to aid in curling the hair. On the other hand, hair straighteners and smoothers operate much like curling irons, but they have flat or curved, smooth mating surfaces which act more like a clothes iron to straighten and/or smooth, or curve or curl the hair when compressed against and pulled along the hair.

OVERVIEW

In one embodiment a hair styling device includes a first plate having a plurality of pins, a second plate having a plurality of pin-receiving apertures, each of the pin-receiving apertures configured to receive at least one respective pin from the first plate, a hinged frame holding the first plate and the second plate and hinged to permit a user to bring the first plate and the second plate into proximity with one another, and a vibrator coupled to vibrate the device.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Figure 1:
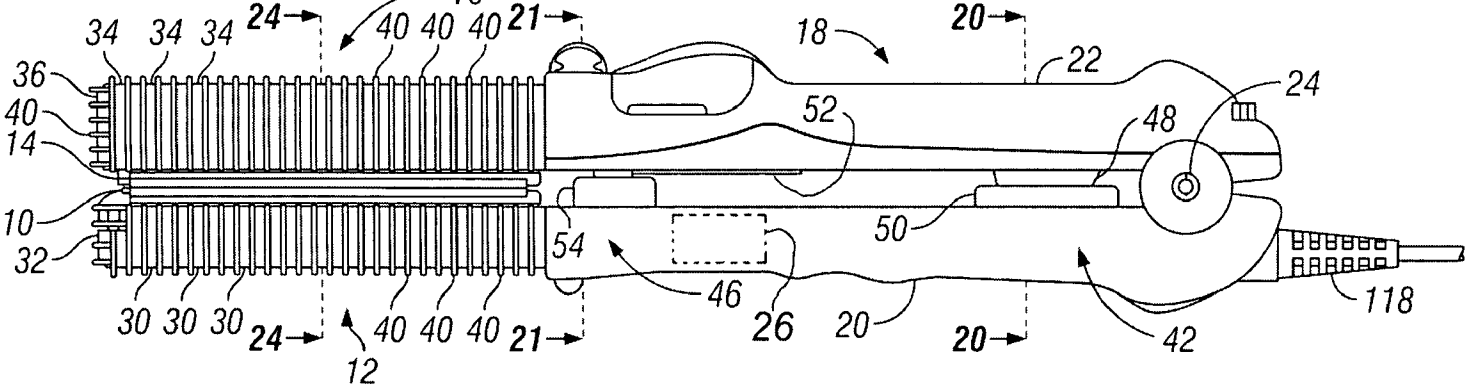
FIG. 1 is a side view of an apparatus for hair styling in accordance with one embodiment.
Figure 2:
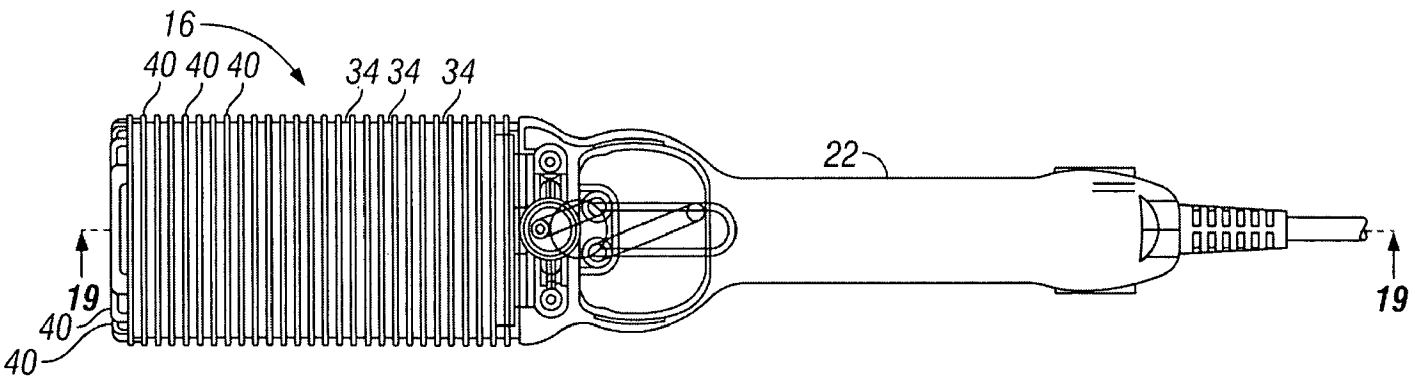
FIG. 2 is a top view of an apparatus for hair styling in accordance with one embodiment.
Figure 3:
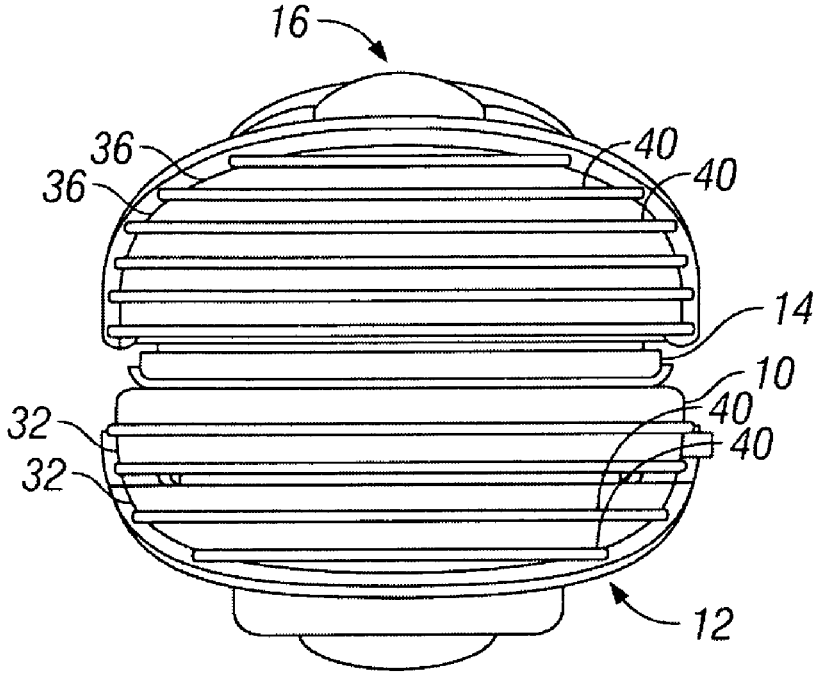
FIG. 3 is a front end view of an apparatus for hair styling in accordance with one embodiment.
Figure 4:
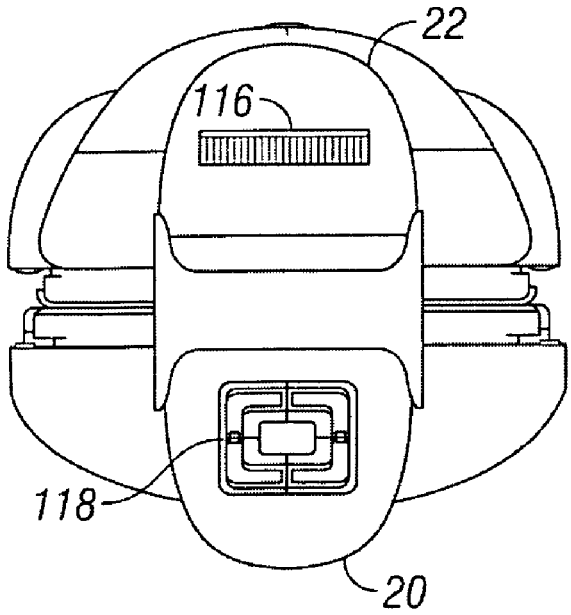
FIG. 4 is a rear end view of an apparatus for hair styling in accordance with one embodiment.
Figure 5:
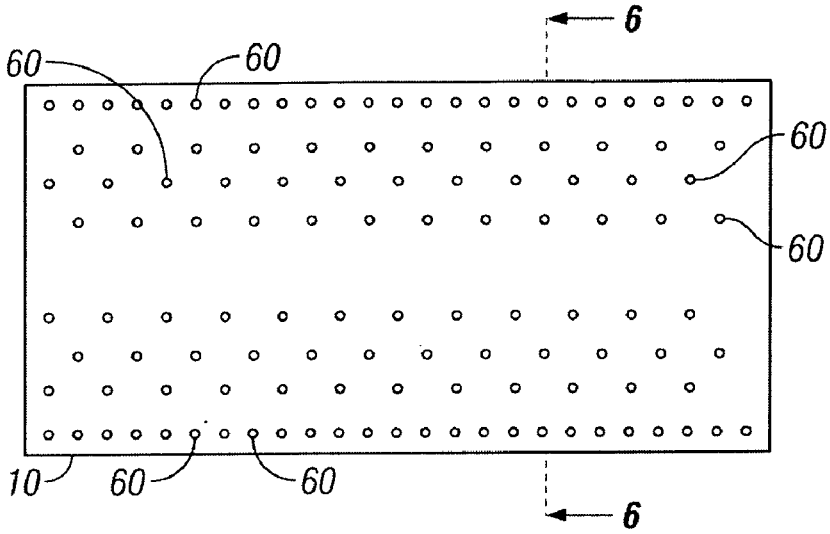
FIG. 5 is a top plan view of one flat surface having pins, of a hair styling apparatus in accordance with one embodiment.
Figure 6:
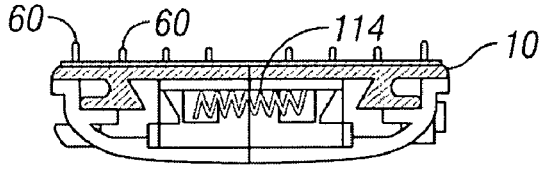
FIG. 6 is a cross sectional view of the surface shown in FIG. 5 taken along line 6-6 of FIG. 5.
Figure 7:
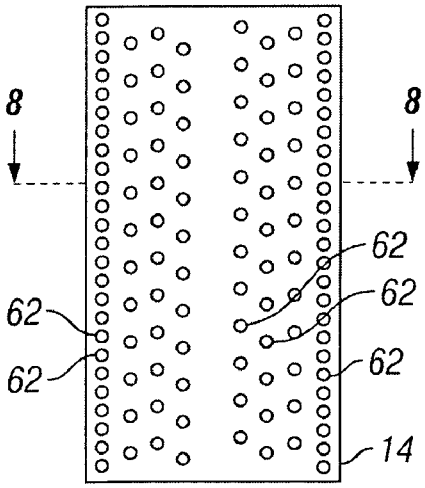
FIG. 7 is a plan view of one flat surface having apertures, of a hair styling apparatus in accordance with one embodiment.
Figure 8:
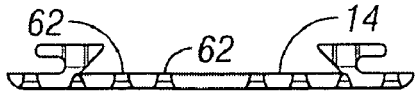
FIG. 8 is a cross sectional view of the surface shown in FIG. 7 taken along line 8-8 of FIG. 7.

Example embodiments are described herein in the context of a hair styling device and method of use thereof. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used throughout the drawings and the following description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

With reference now to FIGS. 1-4, a first plate 10 is connected to a first housing 12 and second plate 14 is connected to a second housing 16 of an embodiment of the hair styling device. The proximal ends of the housings 12 and 16 are coupled to handle 18 which includes a first handle member 20 to which first housing 12 is coupled and a second handle member 22 to which second housing 16 is coupled.

The first handle member 20 and second handle member 22 are coupled together at their proximal ends by hinge 24 and optionally biased toward an open position as, for example, with a spring (not shown) or other types of hinging device. A user of the hair styling device may press the handle members 20 and 22 together to engage the first plate 10 and second plate 14 together into proximity with one another and with the hair to be styled disposed between the plates.

A vibrator 26 is mounted inside the handle member 20 as schematically illustrated in FIG. 1. The vibrator 26 will be further discussed below with reference to FIGS. 19 and 32-33.

Figure 24:
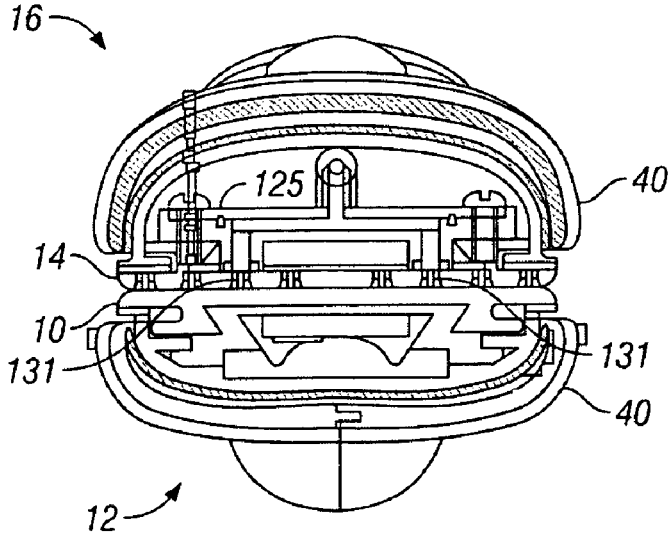
FIG. 24 is a cross sectional view of the device shown in FIG. 1, taken along line 24-24 of FIG. 1.
Figure 25:
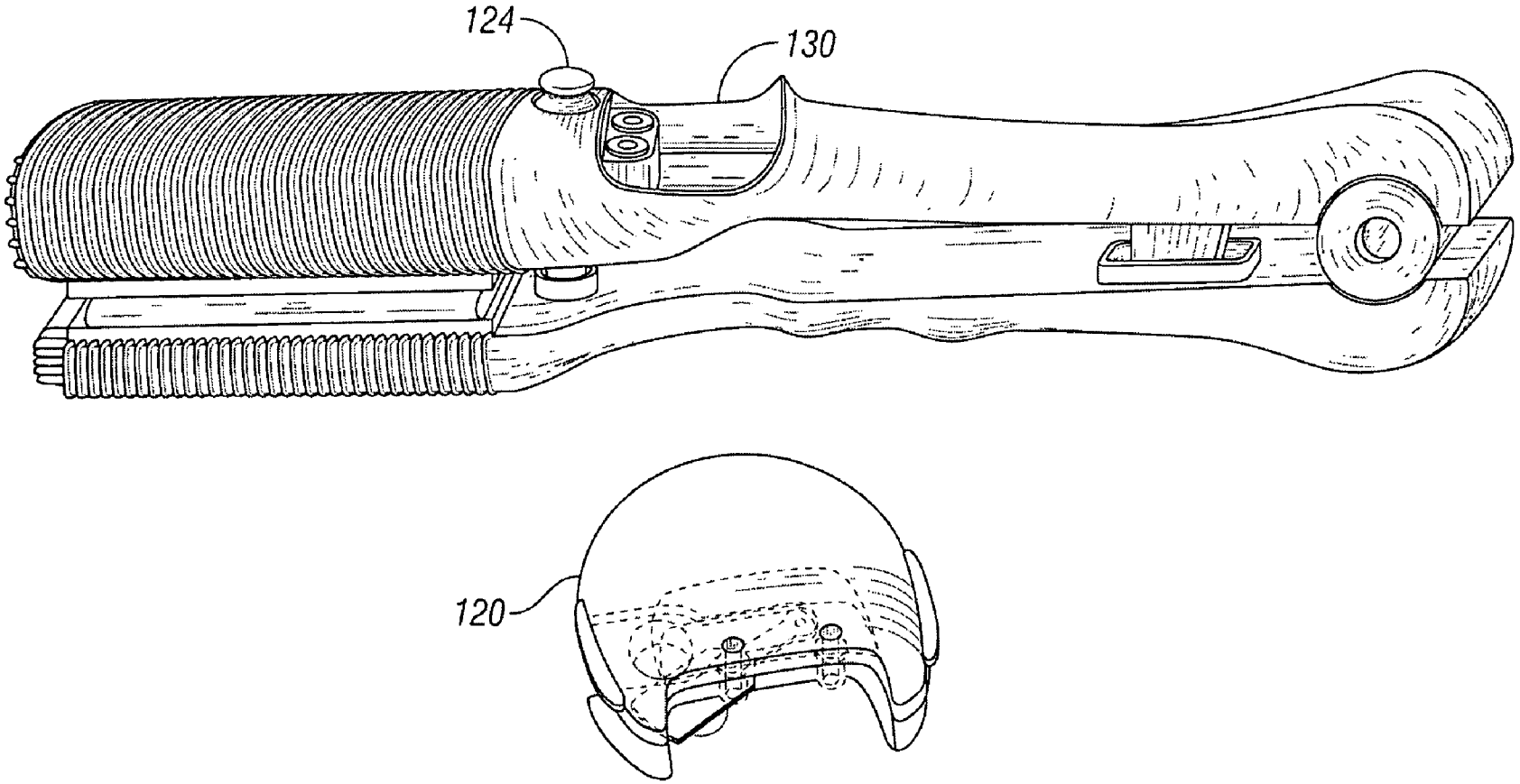
FIG. 25 is a front perspective view of the device shown in FIG. 1 showing the water chamber removed.

The first housing 12 includes a face member 30 and an end member 32. Likewise the second housing 16 includes a face member 34 and an end member 36. A plurality of fins 40 are coupled to the face member 30 and end member 32 of the first housing 12, and a plurality of fins 40 are coupled to the face member 34 and end member 36 of the second housing 16. Each of the fins 40 comprises in one embodiment a substantially flat, thin ridge of constant height, having one edge coupled to a face member or end member and terminating in a rounded end spaced apart from the face member or end member. The fins on a face member are in one embodiment all substantially parallel to one another and spaced apart from each other a constant distance throughout their length although this is not a requirement. Likewise the fins on an end member are in one embodiment all substantially parallel to one another and spaced apart from each other a constant distance throughout their length. As can be seen best in FIGS. 1 and 24 the fins 40 located on face members 30 and 34 extend from a location adjacent one edge of a plate 10 or 14 to a location adjacent the opposing edge of the same plate. As can best be seen in FIGS. 1 and 3, the fins 40 located on an end member 32 or 36 extend from one edge the end member to the opposing edge of the same end member.

During operation of the hair styling device the face members 30 and 34 and the end members 32 and 36 become hot. However, the exposed ends of the fins do not get significantly hotter than ambient temperature. All of the fins 40 are spaced apart from one another a distance less than the width of a finger so that a user of the apparatus may grasp it or inadvertently touch it without touching the face members 30 or 34 or the end members 32 or 36. Thus the fins 40 help protect the user from being burned by the face members or end members.

Figure 20:
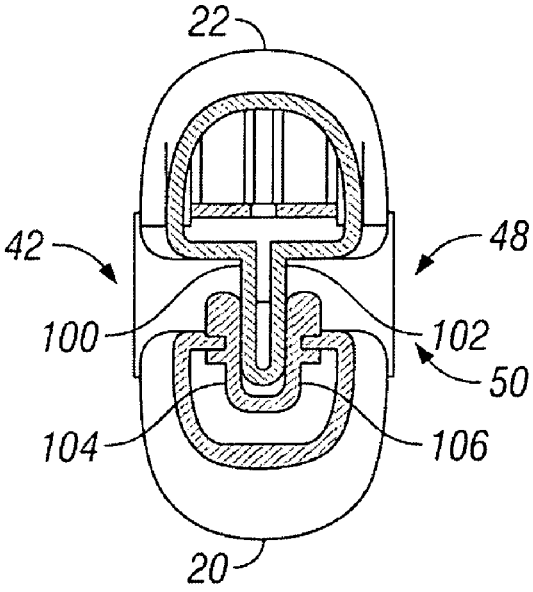
FIG. 20 is a cross sectional view of the device shown in FIG. 1, taken along line 20-20 of FIG. 1.
Figure 21:
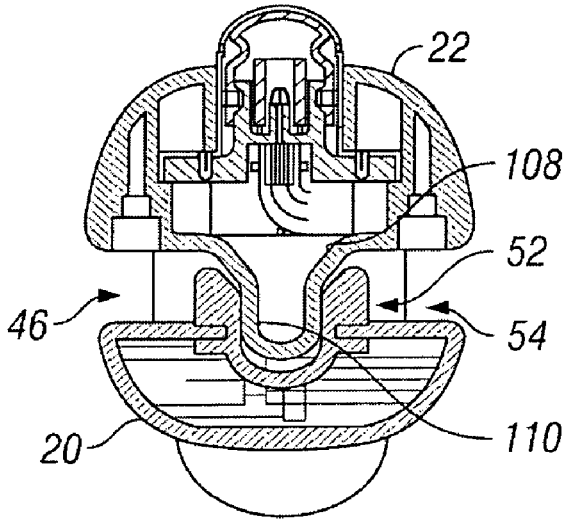
FIG. 21 is a cross sectional view of the device shown in FIG. 1, taken along line 21-21 of FIG. 1.

The handle 18 includes a proximal guide 42 and a distal guide 46 which assist in alignment of the first and second plates 10 and 14 when a user closes the device. As best shown in FIGS. 20 and 21, the proximal guide 42 includes a proximal male alignment part 48 coupled to the second handle member 22 and a proximal female alignment part 50 coupled to the first handle member 20. Similarly, the distal guide 46 includes a distal male alignment part 52 coupled to the second handle member 22 and a distal female alignment part 54 coupled to the first handle member 20.

Turning now to FIGS. 5-8 and 29-31, the first plate 10 has a plurality of pins 60 disposed thereon. The second plate 14 has a plurality of holes or apertures 62 disposed therein. This arrangement may be reversed, if desired. Pins 60 and holes 62 are formed and located so that pins 60 enter holes 62 when first plate 10 and second plate 14 are in close face-to-face relationship when the apparatus is in the "closed" configuration, i.e., with the first plate 10 and second plate 14 in proximity with one another.

Those of ordinary skill in the art will now realize that the diameter, especially the entry diameter, of holes 62; the length and thickness of pins 60; and the length and orientation of first plate 10 and the second plate 14 need to be coordinated so that pins 60 will engage holes 62. Those of skill in the art will now realize, however, that apertures or holes 62 need not be round or of any particular shape and they need not have a one to one correspondence with the pins. For example, a hole or aperture 62 could be formed as a slot receiving a plurality of pins would work as well.

Figure 9:
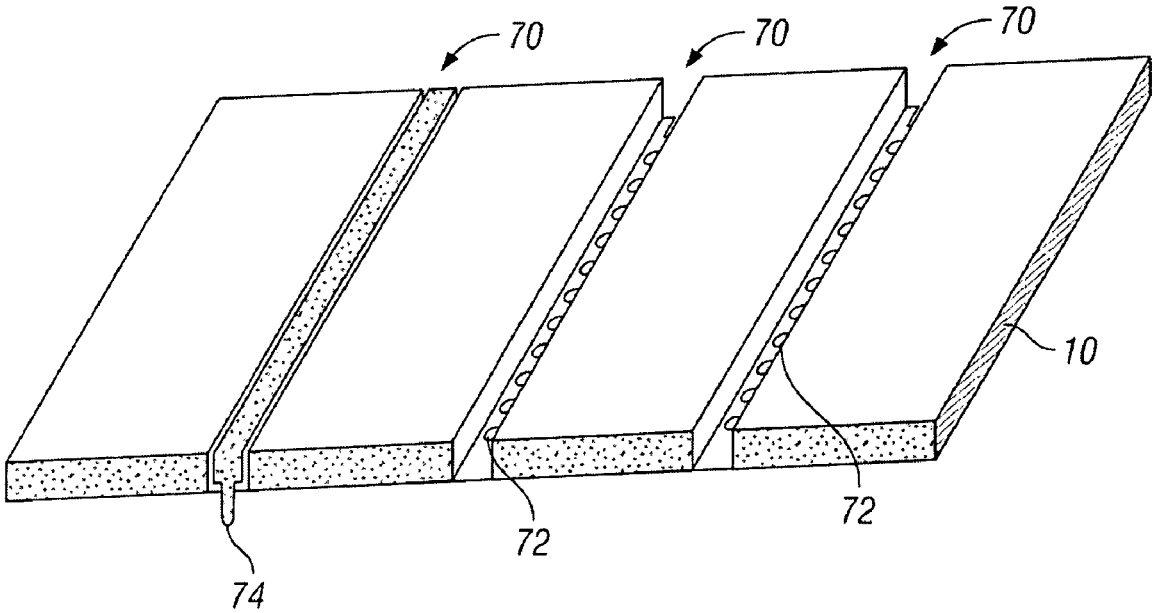
FIGS. 9-18 are drawings illustrating the manufacture of a hair styling apparatus in accordance with various embodiments.

FIG. 9 illustrates an example of how the first plate 10 may be fabricated in accordance with one embodiment. Plate 10 includes a number of slots 70 which include holes 72. A brush-like structure 74 includes a number of pins 60 disposed along its structure. The location of the pins on the comb-like structure 74 mates with holes 72 in a corresponding slot 70 of plate 10. By having the shape of the pins slightly larger in at least one direction than the holes into which the pins are fit, the comb-like structure 74 can be permanently press fit into corresponding slot 70.

If desired, additional alternative or supplemental attachment mechanisms may be used, such as spot welding where the components are metal, adhesives and/or melting where plastics are used. The advantage of this approach is that a smooth finish may be provided to the plate 10 using conventional techniques for preparing a flat surface with a smooth finish. The pins (which may be cast, molded, injected, machined, or otherwise prepared) are then simply inserted through the holes 72 and held in place as discussed above. The fabrication of smooth pins is a conventionally available technology, and thus, the fabrication of the plate 10 in this way yields a snag-free surface with relatively little effort and at relatively low cost.

Figure 10:
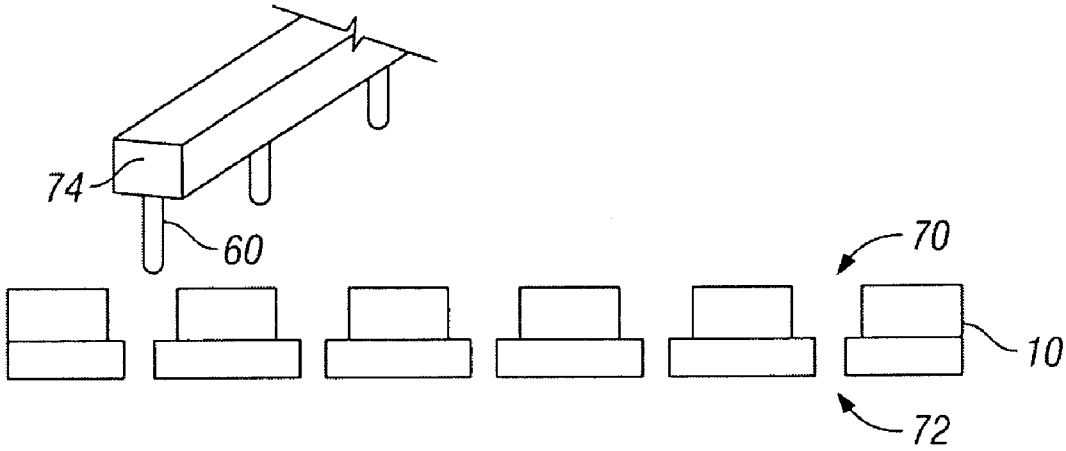
Figure 11:
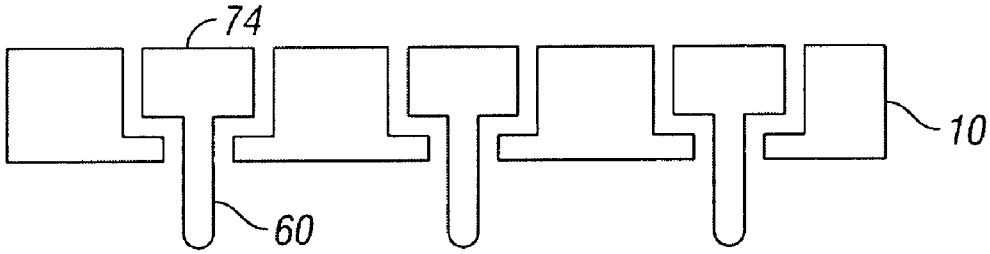
Figure 12:
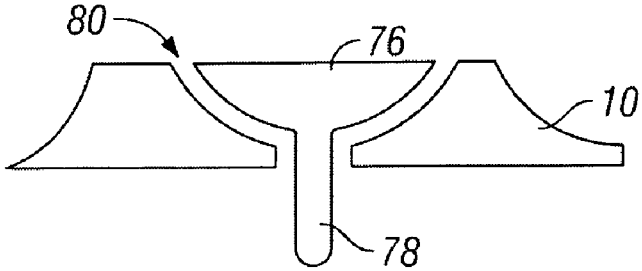
Figure 13:
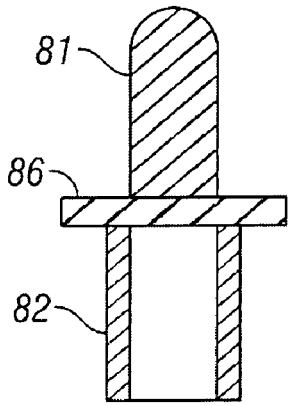
Figure 14:
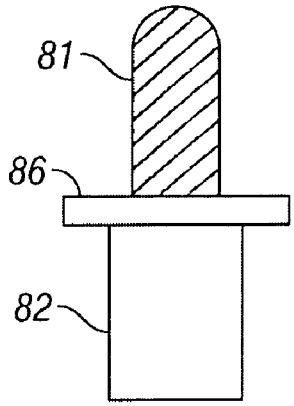
Figure 15:
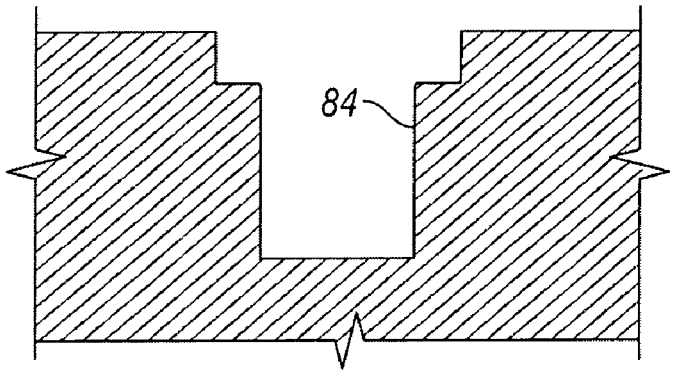
Figure 16:
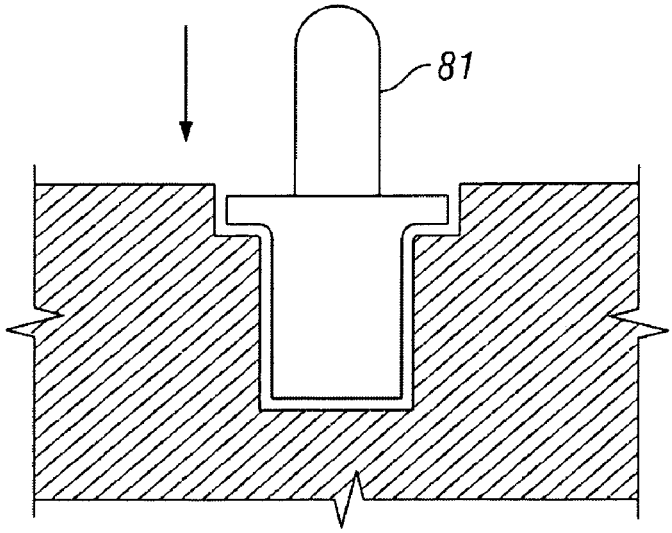

FIG. 10 illustrates a side elevation of plate 10 showing how comb-like structures 74 are inserted therethrough. FIG. 11 illustrates the assembled plate 10. FIG. 12 illustrates an alternative embodiment wherein individual pin carriers 76 (each carrying one pin 78) are inserted into a plurality of receptacles 80 on the back of the plate 10 and may be held in place by an interference fit and/or adhesive or welding techniques.

Another method of fabricating the plate and pin structure is illustrated in FIGS. 13-16. In this embodiment the pins 81 have bases 82 which are substantially hollow cylinders. The plate 10 includes holes 84 which are cylindrical and have diameters slightly less than the outside diameter of the base 82 so that the base can be press-fitted into the holes 84. A flange 86 is affixed to the pin and base to cooperate with a corresponding hole 84 in the plate.

Figure 17:
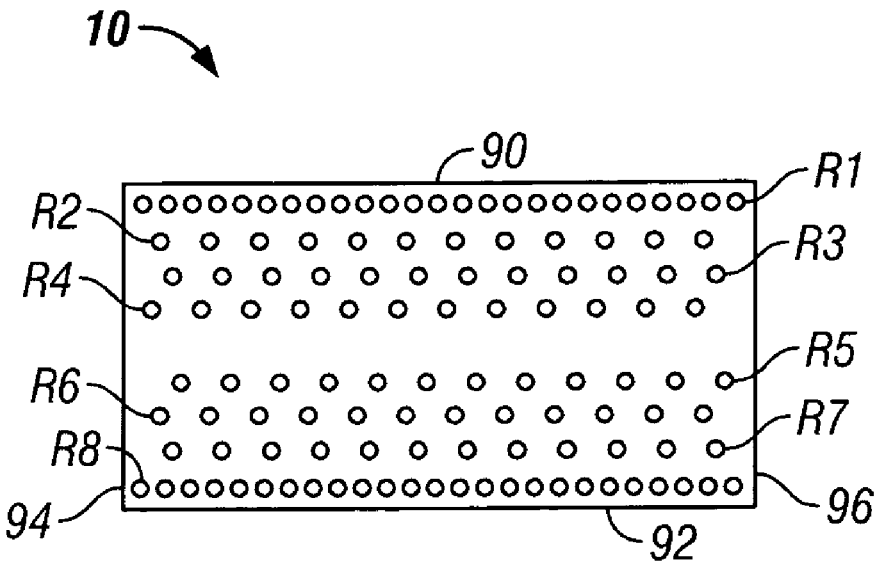
Figure 18:
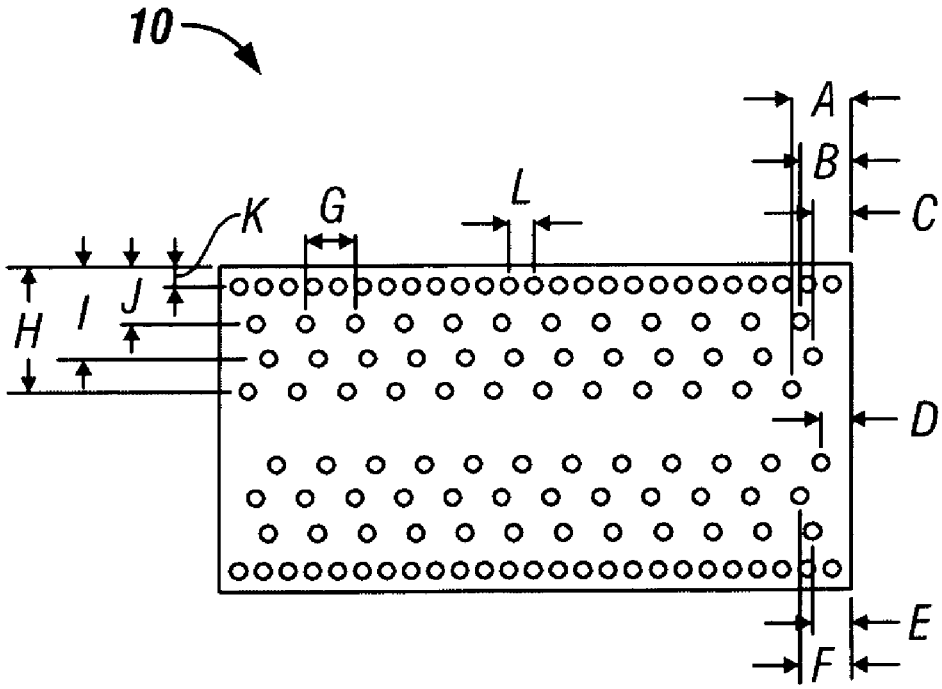

FIGS. 17 and 18 illustrate the location of the pins 60 in accordance with one example embodiment, and it should be understood that the location of the holes or apertures 62 is such that they will engage the pins 60 on either a one to one basis or a one to plural basis. As shown in FIG. 17 the pins are located in 8 rows, labeled R1 through R8, which are parallel to first edge 90 and second edge 92 of the plate 10. Also, the rows R1 through R8 extend between the distal end of the plate 10, which is labeled 94, and the proximal end, which is labeled 96.

In FIG. 18 the location of the pins 60 are shown. The following dimensions in accordance with this example embodiment are in millimeters and are to the centers of the pins. A=10.10, B=8.80, C=6.10, D=4.80, E=6.40, F=8.80, G=7.90, H=21.20, I=15.40, J=9.60, K=3.20, and L=3.95. Two of these dimensions should be emphasized. Distance L is the distance between the centers of each of the pins in rows R1 and R8, namely 3.95 mm, and distance G is the distance between the centers of each of the pins in all other rows, i.e., rows R2 through R7, namely 7.90 mm. An important point to note is that the distances between the pins in rows R1 and R8 are significantly less than the distances between the pins in the other rows. This spacing has been helpful in one example embodiment in detangling curly or wavy hair.

It should be understood that the pins in this example embodiment are spaced as follows:

The first row of pins R1 may be spaced apart from the nearest edge of the first plate 10 by a first distance. The second row of pins R2 may be spaced apart from the first row R1 by a second distance. The third row of pins R3 may be spaced apart from the second row R2 by a third distance, and the fourth row of pins R4 may be spaced apart from the third row R3 by a fourth distance. The second distance may be greater than the first distance and the third distance may be substantially equal to the fourth distance.

The eighth row of pins R8 is spaced apart from the nearest edge of the first plate 10 by a ninth distance. The seventh row of pins R7 is spaced apart from the eighth row R8 by an eighth distance. The sixth row of pins R6 is spaced apart from the seventh row by a seventh distance, and the fifth row of pins R5 is spaced apart from the sixth row R6 by a sixth distance. The eighth distance may be greater than the ninth distance and the seventh distance may be substantially equal to the sixth distance.

The fifth row of pins R5 is spaced apart from the fourth row R4 by a fifth distance, and the fifth distance may be greater than the fourth distance.

Each pin in the first row R1 may be spaced apart from the adjacent pin or pins in the first row R1 by a first distance in the direction perpendicular to the direction of the row R1, i.e. a first Y distance. Each pin in the second row of holes R2 may be spaced apart from the adjacent pin or pins in the second row of pins R2 by a second Y distance, and the first Y distance may be less than the second Y distance.

The holes or apertures are adapted to engage the pins on either a one pin to one hole basis or a multiple pin to one hole basis (e.g., a slot may engage a number of pins).

For example, in a one to one arrangement, the first row of holes R1 is spaced apart from the nearest edge of the second plate 14 by a first distance. The second row of holes R2 is spaced apart from the first row R1 by a second distance. The third row of holes R3 is spaced apart from the second row R2 by a third distance, and the fourth row of holes R4 is spaced apart from the third row R3 by a fourth distance. The second distance may be greater than the first distance and the third distance may be substantially equal to the fourth distance.

The eighth row of holes R8 is spaced apart from the nearest edge of the second plate 14 by a ninth distance. The seventh row of holes R7 is spaced apart from the eighth row R8 by an eighth distance. The sixth row of holes R6 is spaced apart from the seventh row by a seventh distance, and the fifth row of holes R5 is spaced apart from the sixth row R6 by a sixth distance. The eighth distance may be greater than the ninth distance and the seventh distance may be substantially equal to the sixth distance.

The fifth row of holes R5 is spaced apart from the fourth row R4 by a fifth distance, and the fifth distance may be greater than the fourth distance.

Each hole in the first row R1 of this example may be spaced apart from the adjacent hole or holes in the first row R1 by a first distance in the direction perpendicular to the direction of the row R1, i.e. the first Y distance. Each hole in the second row of pins R2 may be spaced apart from the adjacent pin or pins in the second row of holes R2 by a second Y distance, and the first Y distance may be less than the second Y distance.

Although a specific layout of pins and holes has been described and illustrated, it should be understood that this layout is only one example embodiment, and the present invention is not limited to this specific layout.

It should be understood that when a user closes the handles 20 and 22 to bring the plates 10 and 14 into proximity with one another to bear on hair, the pins should line up with corresponding holes. Due to flex in the hinge 24 alignment of the pins and holes to insure correct alignment may be accomplished by means of two guide members 42 and 46.

Figure 19:
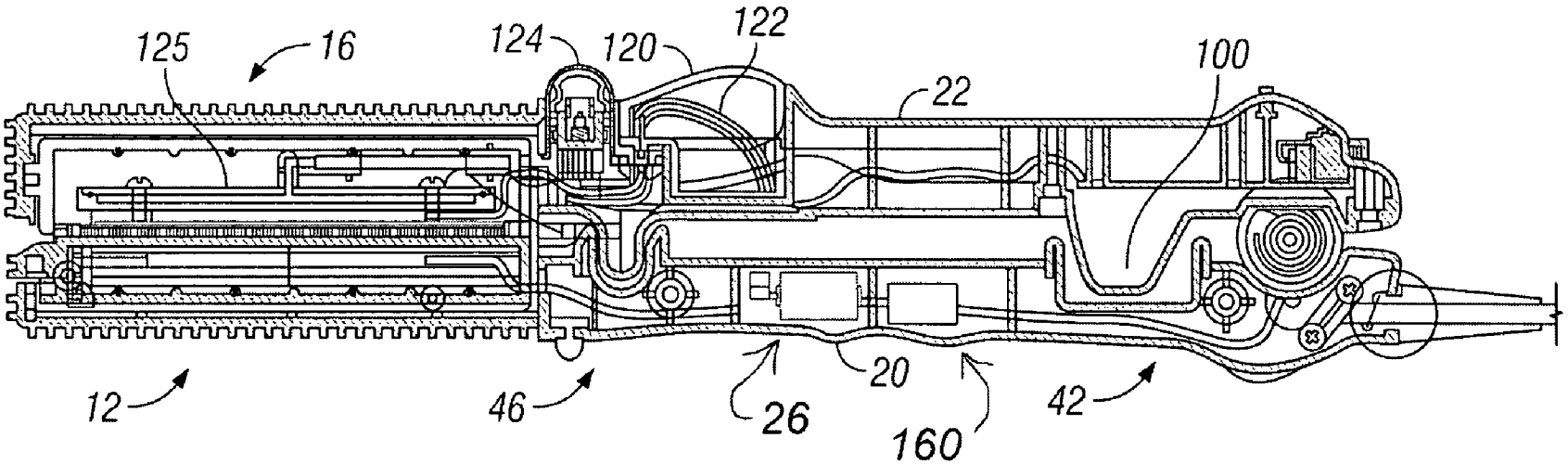
FIG. 19 is a cross sectional view of the device shown in FIG. 2, taken along line 19-19 of FIG. 2.

Turning now to FIGS. 19-21, the proximal guide member 42 includes a proximal male alignment part 48 coupled to the second handle member 22 and a proximal female alignment part 50 coupled to the first handle member 20. The proximal male alignment part 48 has two faces 100 and 102 which are shaped substantially as truncated triangles when viewed in FIG. 19. The two faces 100 and 102 are spaced apart from one another where they are fixed to the handle 22, and the faces are connected to one another at their ends which are spaced apart from the handle 22. Accordingly, when viewed in FIG. 20 it can be seen that the faces 100 and 102 are nearer to one another in the horizontal direction when they are farther from the handle 22 in the vertical direction. The proximal female alignment part 50 has two faces 104 and 106. The two faces 104 and 106 are spaced apart from one another where they are fixed to the handle 20, and the faces are a greater distance from one another at their ends which are spaced apart from the handle 20.

The proximal male alignment part 48 and the proximal female alignment part 50 are constructed and arranged so that when the handle is in the open position the alignment parts are not engaged with one another. As the user moves the handles toward the closed position the proximal male alignment part 48 and the proximal female alignment part 50 engage one another and tend to force the handles into alignment to the extent that they are out of alignment. In other words, when a user moves the handle from a first partially closed position to second partially closed position and from the second partially closed position to the closed position the proximal alignment parts engage one another to cause initial alignment of the first plate and the second plate.

The distal guide member 46 comprises a distal male alignment part 52 coupled to the second handle member 22 and a distal female alignment part 54 coupled to the first handle member 20. The distal male alignment part 52 may include a substantially cone-shaped structure 108 connected to the handle 22 and a substantially cylindrical part 110 connected to the lower end of the cone shaped structure 108. The distal female alignment part 54 may include a conical shaped opening 112 which may be sized to fit snugly around the cone shaped structure 108.

The distal male alignment part 52 and the distal female alignment part 54 may be constructed and arranged so that when the handle is in the open position the alignment parts do not engage one another. As a user moves the handles toward the closed position the handles reach a first partially closed position and the proximal alignment members 48 and 50 initially contact one another to bring about partial alignment. At this time the distal alignment members 52 and 54 do not engage one another. Thereafter, as the user continues to close the handles, and when the handles reach a second partially closed position, the distal alignment parts engage one another to cause final alignment of the first plate and the second plate as the user closes the device.

In accordance with one embodiment, dry heat may be provided to one or both of plates 10 and 14 by incorporating a conventional electrical heating coil 114 behind each respective plate. In this case it would be desirable to form the respective heated (and non-heated) surface of the temperature resistant materials, such as aluminum and high temperature plastics such as Teflon®. An electrical switch 116 is located in the handle to control one or both electrical heating coils. Conventional AC power may be provided by wires 118 to power the circuit, which is not shown.

Figure 32:
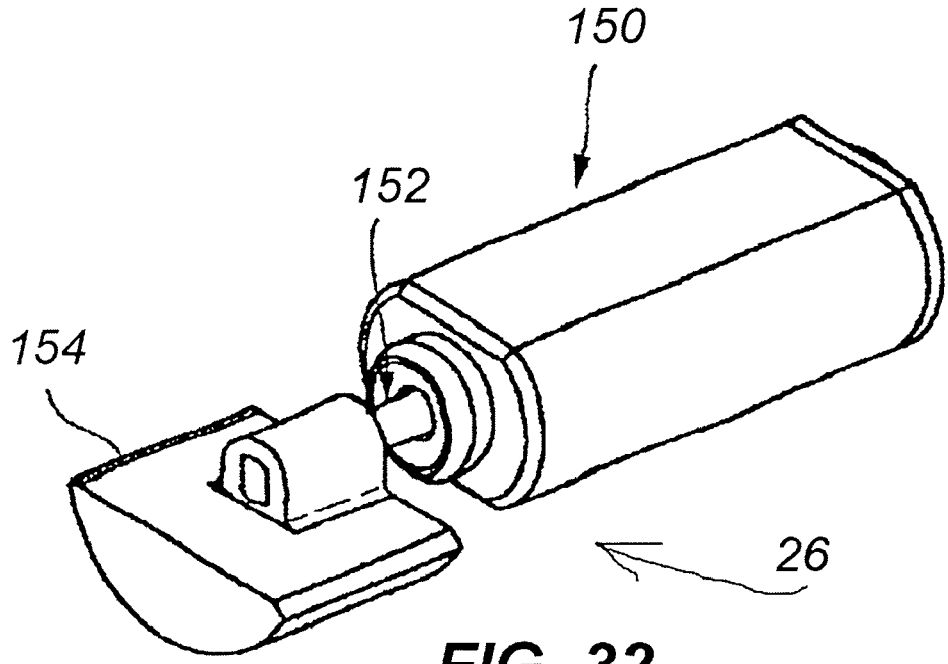
FIG. 32 is an isometric view of the vibrator system of the apparatus for hair styling in accordance with one embodiment.
Figure 33:
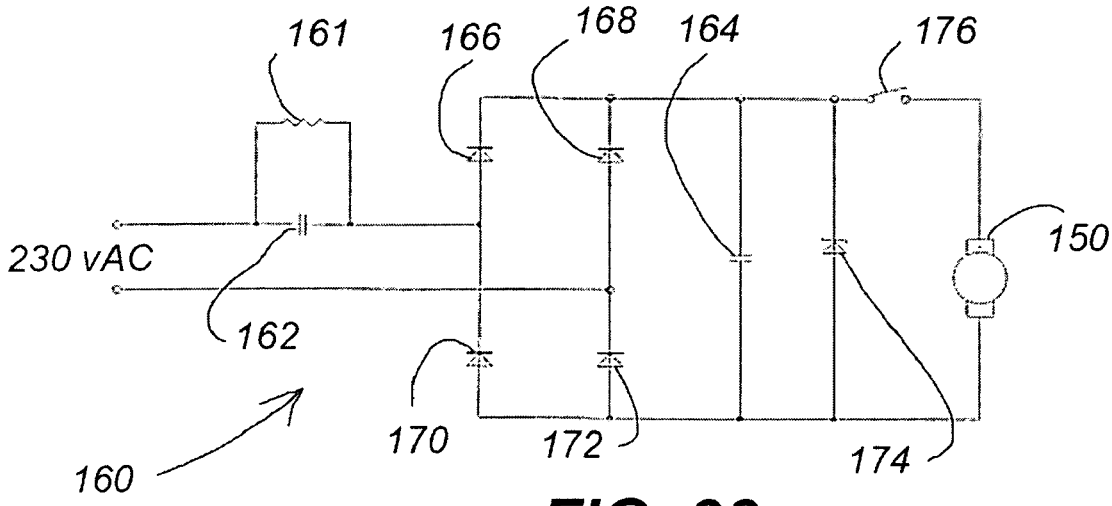
FIG. 33 shows the electric circuit used to power the vibrator motor of the apparatus for hair styling in accordance with one embodiment.

With reference to FIGS. 19 and 32-33, in accordance with one embodiment of the present invention, a vibrator 26 is shown. Vibrator 26 is conventional and may be, for example, of the type commonly used in cell phones as a vibration ringer and therefore will not be discussed in detail herein. The vibrator 26 may include a motor 150 with a rotatable shaft 152. An eccentric weight 154 may be mounted on the shaft 152, and the motor may be mounted to the inside of the first handle member 20. The position of the center of gravity of the eccentric weight 154 is not coincident with the center line of the shaft 152. Accordingly, when the shaft rotates, the vibrator 20 is caused to vibrate thereby causing the first handle member 20 and the complete hair styling device to vibrate. Other types of vibrators may also be used as will now be apparent to those of ordinary skill in the art.

The motor 150 may be powered by the circuit 160 shown in FIG. 33 which comprises resistor 161, capacitors 162 and 164, and diodes 166, 168, 170 and 172. The circuit also includes voltage control tube 174 and switch 176 which can be controlled by the user of the device. In this example the motor 150 operates on DC, and the circuit is powered by AC which is supplied by wires 118 to power the rest of the device as well. Switch 176 may be mounted to turn on motor 150 when the plates 10, 14 are brought into proximity with one another, it may be a push button type switch or a rocker or slide type switch mounted on the side of the device.

In this example the motor is designed to operate at 6000 rpm, which results in vibration of 100 Hertz. In practice operating the motor at 6000 rpm gives good results; however operating at other frequencies should provide satisfactory results as well. Specifically I have found that when the hair styling device, and particularly the first plate 10 and the pins mounted on the plate 10, vibrate at about 100 Hz this aids in reducing tangling of the hair adjacent the pins as the user pulls the device through the hair and results in improved straightening of the hair.

With reference to FIGS. 19 and 22-25, in accordance with one example embodiment of the present invention, steam is provided through holes in the second plate 14.

In accordance with this example embodiment, the second handle member 22 includes a water reservoir 120, and a metered amount of water can be drawn from the reservoir 120 through tube 122 by activation of a pumping mechanism by trigger 124. The water then flows to steam generator 125 which is heated by a heating element 126. This heated water therein forms steam, which then exits the steam emitting holes 128 disposed along the lower surface of steam generator 125. Heating element 126 is supplied electrical current via wires 118. From the steam emitting holes 128 the steam travels through holes 131 in the plate 14.

Figure 22:
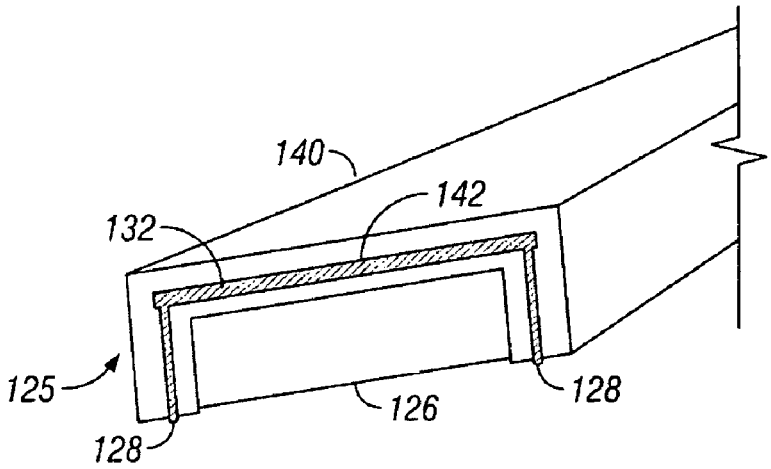
FIG. 22 is a detailed perspective view of a heater and steam generator of a hair styling apparatus in accordance with one embodiment.

As shown in FIG. 22 the steam generator 125 comprises a body 140 which is substantially C-shaped in cross section and extends substantially the length of second housing 16. Within the body 140 there is a steam chamber 142 wherein the water is vaporized and which is substantially C-shaped in cross section and is in communication with the steam emitting holes 128. The steam chamber 142 contains felt 132. The purpose of the felt 132 is to reduce or eliminate the possibility of any condensation which forms in the steam chamber 142 from leaving the steam generator as water droplets.

Figure 23:
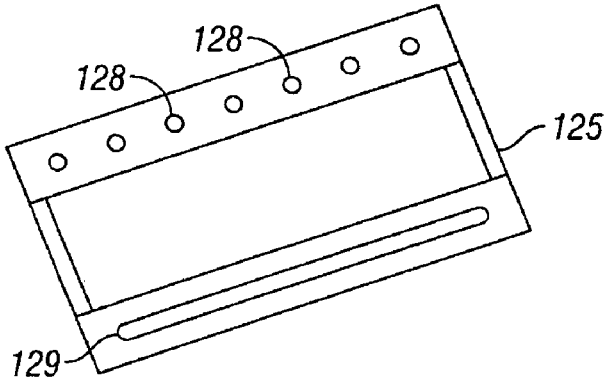
FIG. 23 is another view of the heater shown in FIG. 22.

As can be seen in FIG. 23, as an alternative to a plurality of steam emitting holes 128 disposed along the bottom faces of steam generator 125, slots 129 can be formed along the bottom of the steam generator 125. As can be seen from FIG. 25 the water reservoir 120 is removable from the handle 22, and the handle includes a compartment 130 to accommodate the water reservoir. The reservoir 120 can be removed to facilitate filling it with water.

Figure 26:
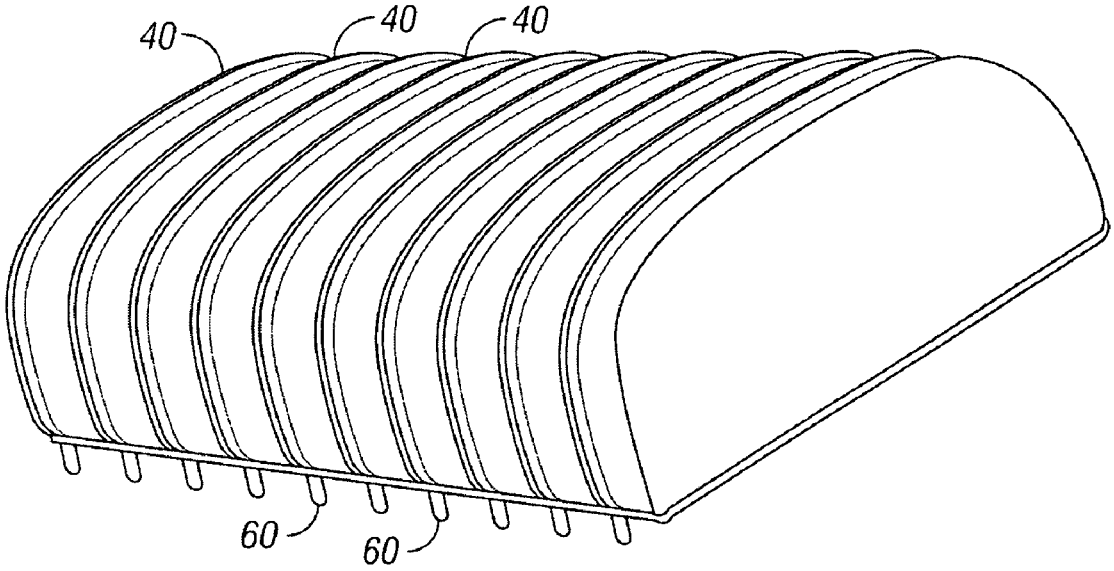
FIGS. 26-28 are detailed illustrations showing a device in accordance with an embodiment as it can be used with hair.
Figure 27:
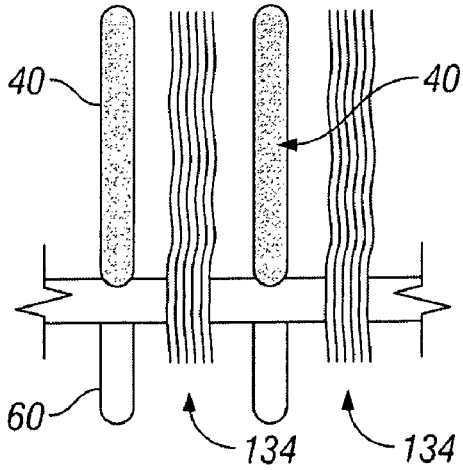
Figure 28:
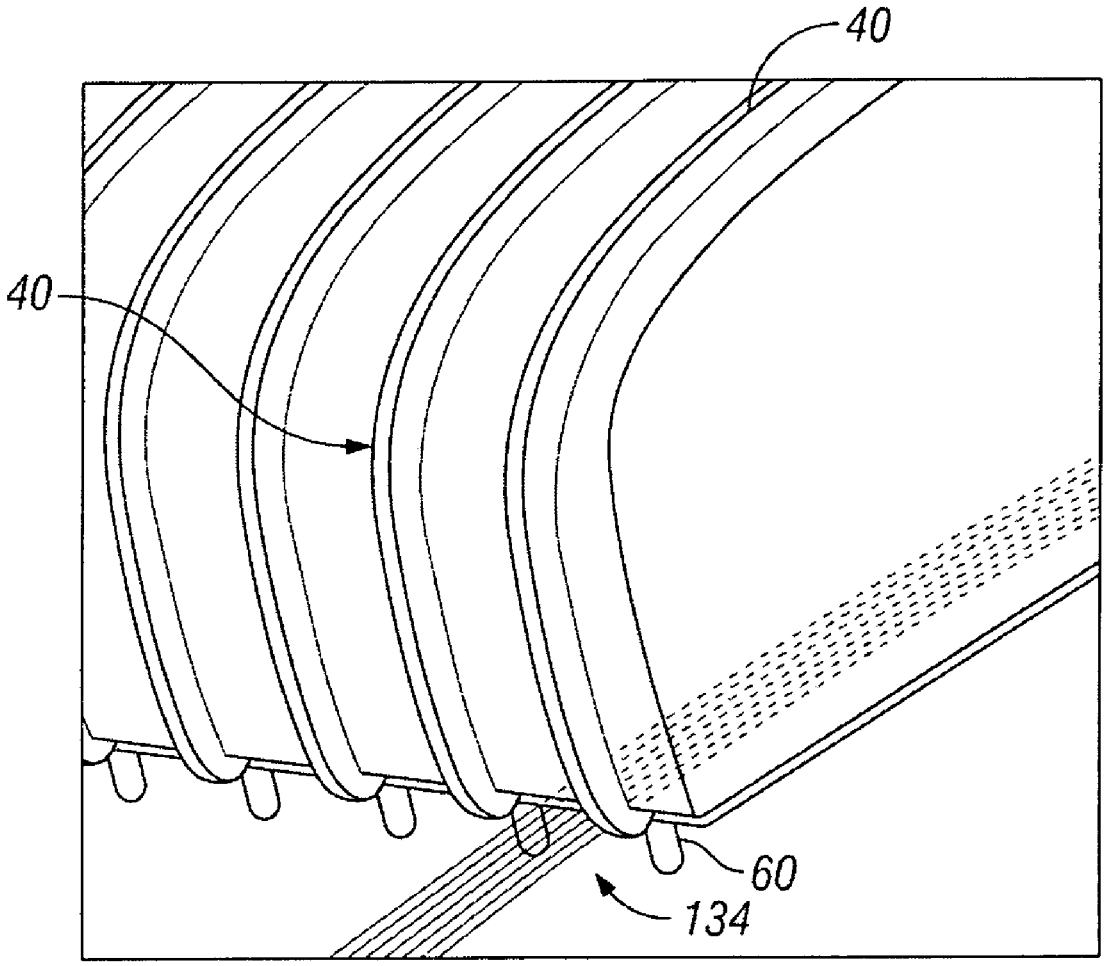
Figure 29:
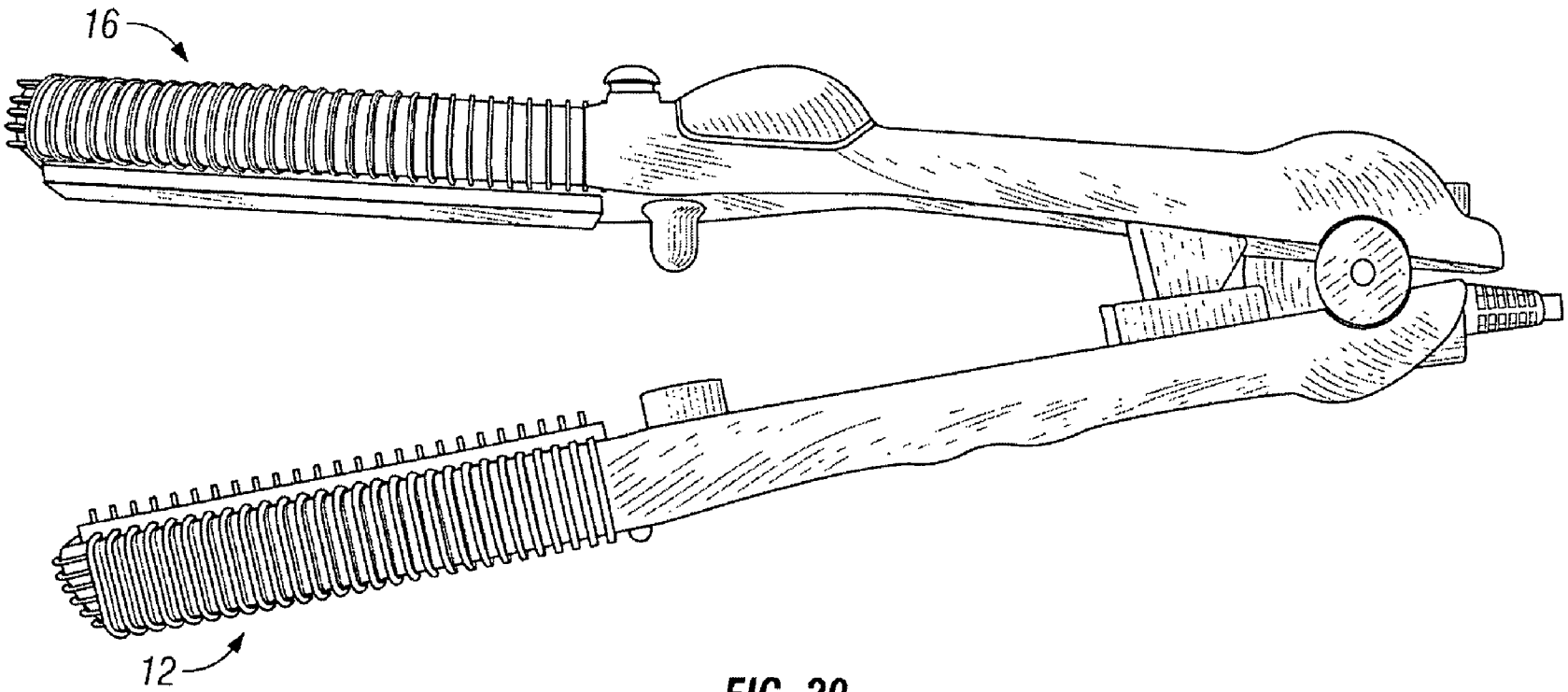
FIG. 29 is a side view of an apparatus for hair styling in accordance with one embodiment in the open position.
Figure 30:
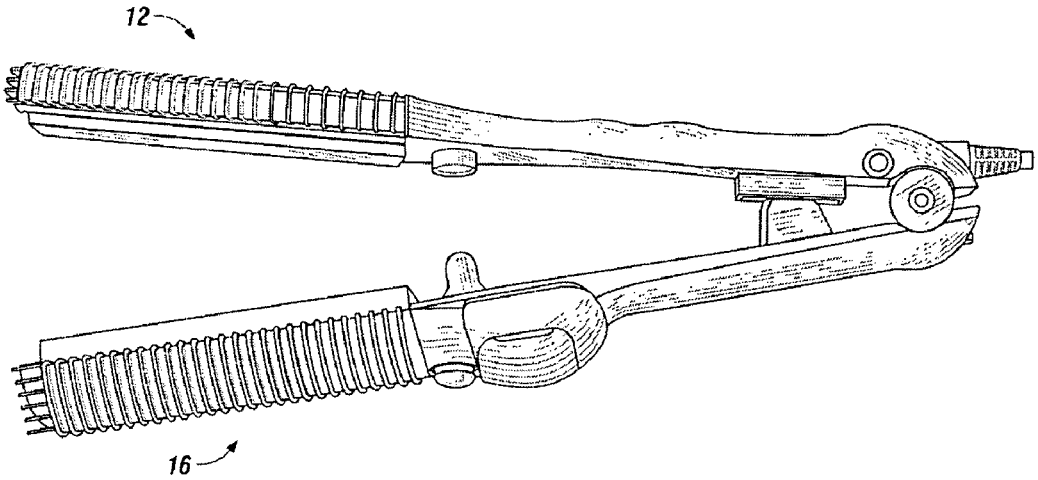
FIG. 30 is a side view of an apparatus for hair styling in accordance with one embodiment in the open position.
Figure 31:
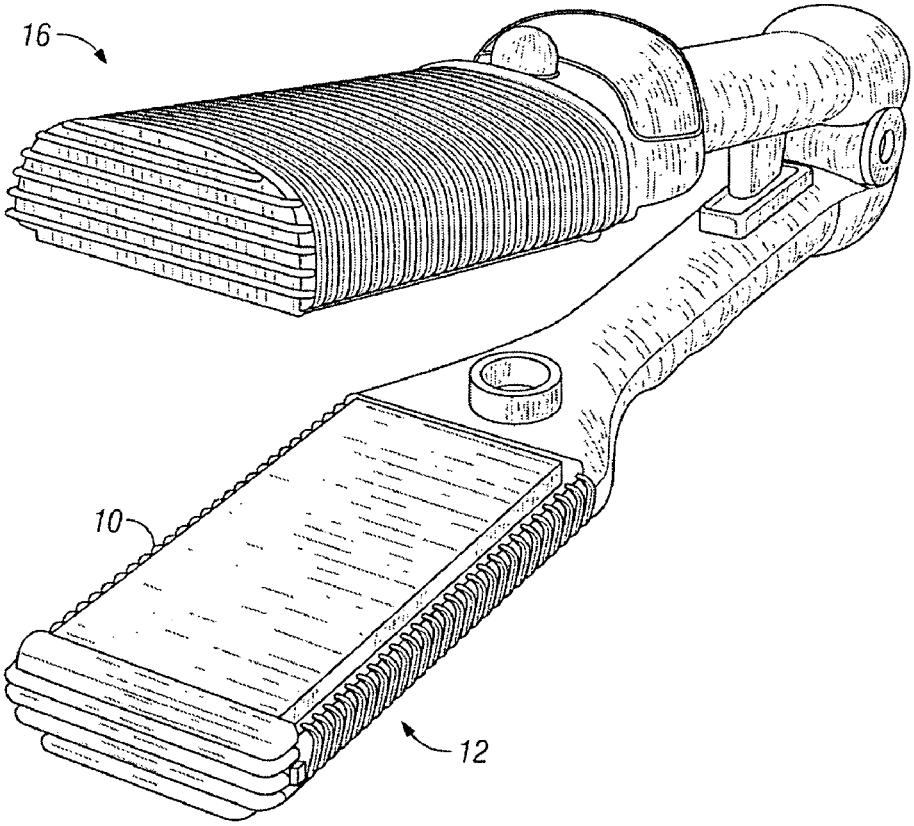
FIG. 31 is an end view of an apparatus for hair styling in accordance with one embodiment in the open position.

With reference to FIGS. 26-28 it can be seen that the fins 40 are aligned with certain of the pins 60. More specifically, when the present device is used to straighten hair 134 it is important that the hair be maintained substantially straight throughout the process. Accordingly, in the preferred embodiment of the present device one fin 40 is aligned with each pin 60 in the first row of pins R1. The fins are linear and extend around the housing 12, and on the opposite side of the plate 10 are aligned with a corresponding pin 60 in the eighth row of pins R8, not shown. Since the pins in both rows R1 and R8 are aligned with a fin 40 the user can conveniently use the device effectively with either hand and on either side the head.

It should also be noted that fins 40 may extend beyond the plane of the upper surface of the corresponding heated plates 10, 14 to provide additional protection to prevent having a finger or other part of the body come in contact with the heated plates 10, 14. Similarly, while round pins and apertures are shown and described herein, other shapes could also be employed as will now be apparent to those of ordinary skill in the art.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A hair styling device comprising:

a first plate including a plurality of pins including pins in a first edge row, pins in a second edge row, and pins in at least a first intermediate row and a second intermediate row, wherein pins of the first edge row and the second edge row are more closely spaced than pins of the first intermediate row and the second intermediate row, wherein corresponding pins of the first edge row and the second edge row are aligned, and wherein pins of the first intermediate row are staggered relative to pins of the second intermediate row;

a second plate including a plurality of pin-receiving apertures, each of the pin-receiving apertures configured to receive at least one respective pin from the first plate;

a hinged frame holding the first place and the second plate and hinged to permit a user to bring the first plate and the second plate into proximity with one another;

a heater, incorporated into at least one of the first and second plates for heating hair engaged between the first and second plates; and, a vibrator coupled to the device for vibrating and styling heated hair engaged between the first and second plates.

2. The device of claim 1, wherein:

the apertures and the pins are arranged in a one to one configuration.

3. The device of claim 1, wherein:

the apertures and the pins are configured so that more than one pin is arranged to enter one aperture when the apparatus is used.

4. The device of claim 3, wherein:

the apertures are configured as slots.

* * * * *